US005117843A

United States Patent [19]

Holmes et al.

[11] Patent Number: 5,117,843

[45] Date of Patent: Jun. 2, 1992

[54] METHOD OF AND APPARATUS FOR RECLAIMING TOBACCO FROM CIGARETTE PACKAGES

[75] Inventors: Gregory A. Holmes; Clifford R. Marritt, both of Winston-Salem, N.C.

[73] Assignee: R. J. Reynolds Tobacco Company, Winston-Salem, N.C.

[21] Appl. No.: 493,082

[22] Filed: Mar. 13, 1990

[51] Int. Cl.[5] ..... A24C 5/36

[52] U.S. Cl. ..... 131/96

[58] Field of Search ..... 131/280, 96

[56] References Cited

U.S. PATENT DOCUMENTS

| | | |
|---|---|---|
| 3,026,880 | 3/1962 | Perrin . |
| 3,103,222 | 9/1963 | DiIanni . |
| 3,224,451 | 12/1965 | Dearsley . |
| 3,386,320 | 6/1968 | Pinkham et al. . |
| 3,577,999 | 5/1971 | Pinkham . |
| 3,757,799 | 9/1973 | DiIanni et al. . |
| 4,002,255 | 1/1977 | Fincham et al. . |
| 4,036,380 | 7/1977 | Berry et al. . |
| 4,083,499 | 4/1978 | Thatcher . |
| 4,117,852 | 10/1978 | Newman et al. . |
| 4,191,199 | 3/1980 | Sullivan . |
| 4,221,035 | 9/1980 | Thatcher . |
| 4,261,790 | 4/1981 | Brinker et al. . |
| 4,278,100 | 7/1981 | Thatcher . |
| 4,485,827 | 12/1984 | Komossa et al. . |
| 4,622,875 | 11/1986 | Emery et al. . |
| 4,843,801 | 7/1989 | Roncero . |
| 4,867,179 | 9/1989 | Leonard . |

FOREIGN PATENT DOCUMENTS

| | | |
|---|---|---|
| 0118289 | of 1984 | European Pat. Off. . |
| 2158410 | of 1985 | United Kingdom . |

*Primary Examiner*—V. Millin

[57] ABSTRACT

An apparatus and method for making cigarettes and reclaiming tobacco from rejected cigarettes and rejected cigarette packs are disclosed. A system and method is disclosed for making and packing cigarettes in which tobacco is recovered from individual rejected cigarettes and rejected cigarette packs and then recycled to the maker for inclusion in new cigarettes. Included in the system and method is an apparatus and method for removing cigarettes from cigarette packs to facilitate individual cigarette recovery and tobacco reclamation, in which individual packs of cigarettes are conveyed to an opener stage which removes both end panels of a cigarette pack, and then to an extraction stage which increases the cross-sectional area of the pack, thereby loosening the packed cigarette matrix, applies a nonintrusive removal force, removing the cigarettes from the pack and separating the empty pack from the removed cigarettes. The cigarettes are transported to further processing which may include repacking of intact and otherwise acceptable individual cigarettes or, alternatively, separation of the tobacco from the filter and paper of the cigarettes. Optionally, the filters and the end panel at the filter end of the pack may be cut off, thereby eliminating the likelihood of filter material contamination of the tobacco, such as charcoal contamination. Two embodiments of the opener stage apparatus are disclosed, namely, apparatus for the simultaneous cutting off of pack end panels or the staggered serial cutting off of pack end panels. Four embodiments of the extraction stage are disclosed which, include apparatus for: extraction by gravity forces; extraction by centrifugal forces (two embodiments); and extraction by an air jet. It is also contemplated that in certain circumstances, the cigarette matrix in the pack can be altered sufficiently to assist in removal so that only one end panel of the pack need be cut off.

34 Claims, 9 Drawing Sheets 106
104
209
P
402
404
180
120
210,220
121
260
410
420
280
119
126
122
123
127
128
146
150
152
154
156
158
168
142
144
220

DRIVE WHEEL AND MOTOR
DRIVE MOTOR 122
126
210
120
220
128
129
P
561
560
108
R
502
135
131
211
213
133
137
139
510
512
514
516
504
7b

METHOD OF AND APPARATUS FOR RECLAIMING TOBACCO FROM CIGARETTE PACKAGES

FIELD OF THE INVENTION

The present invention relates to the reclamation of smokable material used in making smoking articles such as cigarettes, and in particular, to a method of and an apparatus for making cigarettes which includes the steps of and means for opening cigarette packs, removing cigarettes from the packs to facilitate individual cigarette recovery, and removing the smokable material from the recovered cigarettes, thereby facilitating tobacco reclamation.

DESCRIPTION OF THE PRIOR ART

Cigarettes which may be recovered and reclaimed according to the present invention can vary in composition and construction. Typically, cigarettes comprise a rod of smokable material, such as a blend of shredded tobacco laminae, volume expanded shredded tobacco laminae, cut and processed tobacco stems, shredded reconstituted tobacco, and the like. The smokable material or cut filler is circumscribed by an outer wrapping material such as cigarette paper, e.g., a calcium carbonate and flax paper, thereby forming a tobacco rod. Tobacco rods typically have lengths of about 40 mm to about 85 mm, preferably about 55 mm to 70 mm, and circumferences of about 17 to about 27 mm, preferably about 22 mm to about 25 mm. For filter cigarettes, a filter element normally manufactured from plasticized cellulose acetate tow and circumscribed by a paper plug wrap is attached to one end of the tobacco rod. Filter elements can have flavors incorporated therein, contain charcoal, or the like. Filter elements typically have lengths of about 10 mm to about 40 mm, preferably about 15 to about 35 mm; and have circumferences comparable to that of the tobacco rod with which they are employed. A tipping paper typically circumscribes the filter element and an adjacent region of the tobacco rod so as to fixedly secure the filter element to the tobacco rod. Typical filter cigarettes are about 79 mm, about 84 mm and about 99 mm in length.

Cigarettes conventionally have been sold in packages called "packs," and each pack normally contains 20 cigarettes. The cigarettes are usually arranged in a matrix of three rows having 7 cigarettes, 6 cigarettes and 7 cigarettes, respectively. Typical cigarette packs have a generally rectangular parallelepiped form, with front and back panels, two side panels and two end panels. According to the terminology used herein, the two end panels are the top and bottom of the pack. One type of popular cigarette pack employs a container having the form of a so-called "hard pack," "crush proof box" or "hinged lid package." Another type of popular cigarette pack employs a container having the form of the so-called "soft pack." Both types of cigarette pack typically are overwrapped by a clear polymeric film (e.g., a polyethylene or polypropylene overwrap film) to maintain freshness of the cigarettes within the container. A strip of polymeric material known as a "tear tape" is provided adjacent the top of the pack for easy opening of the polymeric overwrap film. Cigarette packs are packaged in cartons, typically ten packs per carton.

In order to maintain proper quality control during the manufacture and packaging process, defective packs or cartons are eliminated from the ultimate product stream, and separated for further reprocessing and reclamation of the tobacco therein. In addition, individual packs and cartons, which are otherwise acceptable, but which were part of field tests or promotional efforts which have expired or which have been completed, may also be returned for reclamation. Heretofore, in order to effect the removal of the tobacco from the packs and cartons, a significant amount of manual labor was involved. This included the opening of the individual cartons and then the opening of the individual packs, the removal of the cigarettes and the ultimate removal of the tobacco from the cigarettes. Alternatively, a hammermill was used to break up whole cartons and/or packs into a particulate mixture of tobacco, packaging material, filter elements and cigarette paper and thereafter the tobacco particles were separated from the mixture. For example, U.S. Pat. No. 3,577,999, issued to Pinkham, is directed to a rotating vane device and sieve for separating tobacco from the filter and paper. The tobacco that is removed from the cigarettes is collected, reconstituted and reconditioned and then introduced into the tobacco blend as "shorts".

Suitable methods and systems for in-line tobacco reclamation with a maker/tipper/packer have been developed previously. Among these are the method and system disclosed in U.S. Pat. No. 4,867,179, which issued to Leonard, and is assigned to the assignee of this invention. The system and method disclosed in Leonard is directed to tobacco reclamation from one or more cigarette making machines, in which cigarettes are reclaimed from packs and the tobacco is separated from reclaimed cigarettes, rejected cigarettes and long ends. The separated tobacco is then screened and metered. The larger tobacco particles are redirected back to the tobacco supply for the cigarette maker and the smaller tobacco particles are metered and formed into reconstituted tobacco which is then cut and fed back to the tobacco supply.

In addition, various other efforts have been undertaken to automate the tobacco reclamation process. Examples of efforts directed to removing cigarettes from cigarette packs include the following patent documents: U.S. Pat. No. 4,843,801, issued to Roncero; U.S. Pat. No. 4,083,499, issued to Thatcher; U.S. Pat. No. 4,221,035, issued to Thatcher; European Patent Publication No. 0118289; U.K. Patent Application No. GB2158410A; U.S. Pat. No. 3,386,320, issued to Pinkham et al.; U.S. Pat. No. 4,622,875, issued to Emery et al.; and U.S. Pat. No. 4,002,255, issued to Fincham et al.

In addition to patents directed to the removal of cigarettes and tobacco from intact packages, efforts have also been directed toward removal of tobacco from individual cigarettes as well. Examples of such efforts include: U.S. Pat. No. 4,261,790, issued to Brinker et al.; U.S. Pat. No. 4,278,100, issued to Thatcher; U.S. Pat. No. 4,117,852, issued to Newman et al.; U.S. Pat. No. 3,103,222, issued to Dilanni; U.S. Pat. No. 4,191,199; U.S. Pat. No. 3,757,799, issued to Dilanni et al.; U.S. Pat. No. 3,026,880, issued to Perrin; U.S. Pat. No. 3,224,451, issued to Dearsley; and U.S. Pat. No. 4,485,827, issued to Komassa et al.

Many of the prior art methods and apparatus for tobacco reclamation involve intrusive, destructive means and methods for performing the separation of cigarettes from packaging materials. Such means and methods often resulted in degradation of the tobacco itself, either by reducing the size of the tobacco fiber strands, or in drying out the tobacco. Additionally, the option of recovering intact and otherwise acceptable individual cigarettes is limited in those processes which separate cigarettes from packs by means of devices which interact simultaneously with the cigarettes and packaging materials as, for example, by beating the packs with a hammermill or by slicing the packs and cigarettes. Furthermore, because in many of the abovementioned prior art methods and devices, the packaging, cigarette paper and filter material are each being subjected to the same separation forces as the tobacco, there is an increased likelihood that the tobacco will suffer some contamination of the non-tobacco parts i.e., the paper, foil, etc. of the packaging or tow, charcoal, flavorant, etc. of the filter.

As a result of the deficiencies in prior tobacco reclamation efforts, it is desirable to provide a method and apparatus for the in-line reclamation of tobacco used in making cigarettes which includes the steps of and means for opening cigarette packs and removing cigarettes from the packs to facilitate individual cigarette recovery and removing the tobacco from the recovered cigarettes, thereby facilitating tobacco reclamation. Such desirable method and apparatus should accomplish this result while minimizing the degradation of the recovered cigarettes and reclaimed tobacco.

SUMMARY OF THE INVENTION

The present invention is directed to a method and apparatus useful for making cigarettes and also possessing the capability of providing for tobacco recovery and reclamation. The invention offers a minimally intrusive method of and apparatus for removing individual cigarettes from cigarette packs, allowing for minimal contamination of the resulting reclaimed tobacco. According to the present invention, an apparatus for removing individual cigarettes from cigarette packs can be used (i) in-line with a cigarette maker/tipper/packer to reclaim tobacco filler from individual cigarettes or (ii) for separate from a maker/tipper/packer reclamation of tobacco filler from individual cigarettes. In addition, the apparatus of the invention can be adjustable to allow removal of filter tips from filter cigarettes and also to accommodate different length cigarettes and packs. The likelihood of damage to or degradation of the reclaimed tobacco is reduced using the present invention. When used in an in-line maker, the method and apparatus do not result in diminished tobacco moisture content, because reclaimed tobacco is returned with substantially the same moisture content as it had when first made into cigarettes. Typical moisture content of tobacco filler material is 10 to 15%, preferably 12 to 13% during cigarette manufacture. Substantial recovery and return of tobacco is possible, with 95% or more of the tobacco being removed from cigarettes being returned to the cigarette maker for the manufacture of new cigarettes.

The present invention is directed to a method and apparatus for making cigarettes and reclaiming tobacco including a method and apparatus in which individual packs of cigarettes are conveyed to an opener stage which removes both end panels of a cigarette pack, i.e., the top and bottom panels, and then to an extraction stage in which (a) the cross-sectional area of the pack in a plane substantially parallel to the pack ends is increased, thereby loosening the packed cigarette matrix, and (b) a non-intrusive removal force is applied to remove the cigarettes from the pack and to separate the packaging material from the removed cigarettes, without any apparatus or device actually entering the pack. The removed cigarettes are transported to further processing in which the tobacco is separated from the filter and paper of the cigarettes and the tobacco is returned to the input hopper for the maker. Alternatively, the further processing could involve repacking of intact and otherwise acceptable individual cigarettes into packs. The packaging material itself is preferably disposed of, but may be recycled where appropriate.

The present invention offers the option of cutting the pack in a plane displaced from the end panel at the filter end of the pack so as to cut off the filters from the cigarettes, thereby eliminating the possibility of filter material contamination of the tobacco, such as tow or charcoal contamination. The present invention involves either the simultaneous cutting off of cigarette pack end panels or, alternatively, the staggered serial cutting off of cigarette pack end panels (i.e., first one end and then the other). According to the present invention, cigarettes can be extracted from packs using (i) gravity forces alone; (ii) centrifugal and gravity forces; or (iii) forces provided by an air jet.

DETAILED DESCRIPTION OF THE INVENTION

Figure 1A:
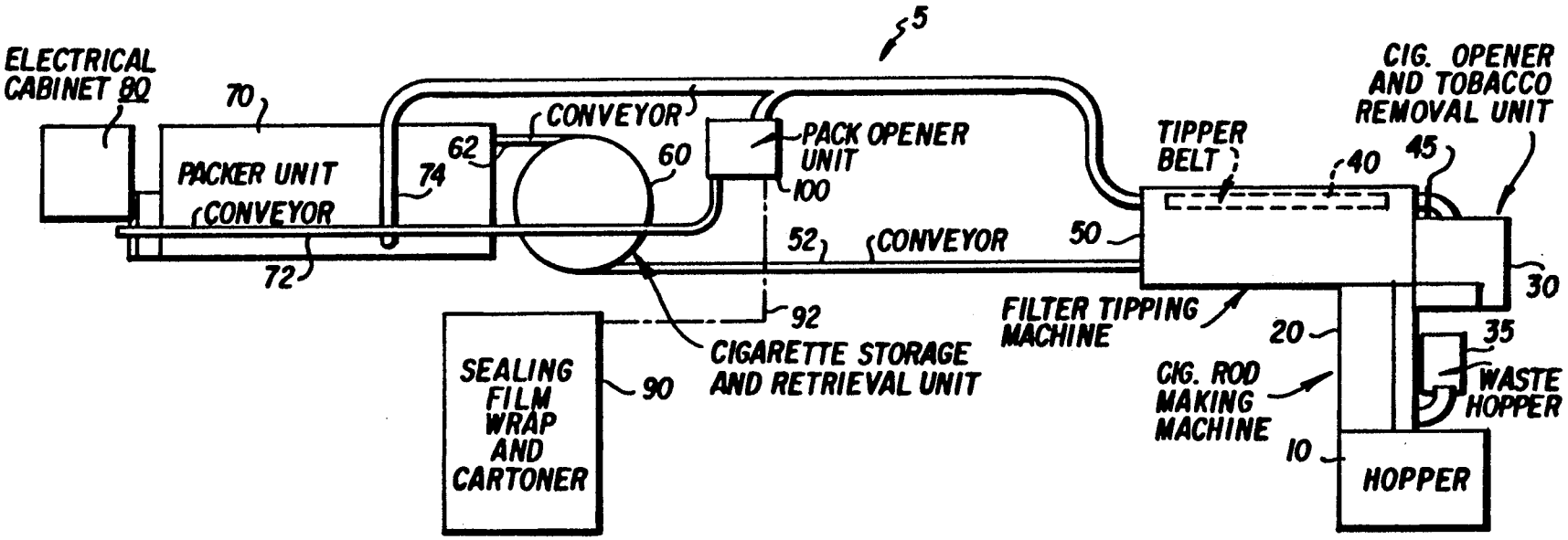
FIG. 1*a* is a schematic of a cigarette maker/packer system which incorporates an in-line pack opener and wet-belt type cigarette opening device according to the present invention.
Figure 1B:
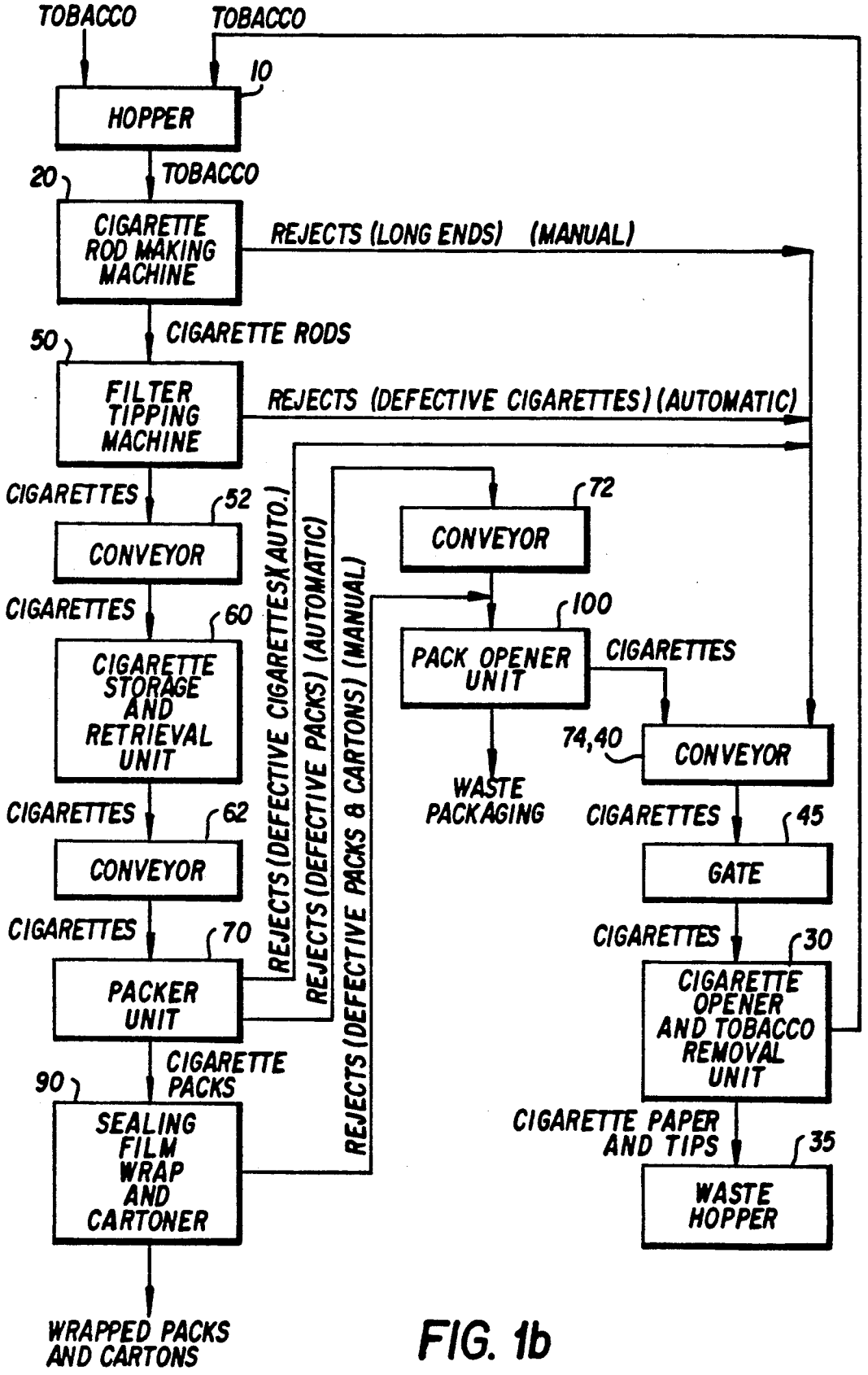
FIG. 1*b* is a flow chart of a cigarette maker/packer which incorporates an in-line pack opener and wet-belt type cigarette opening device according to the present invention.

FIG. 1*a* is a schematic representation of a cigarette maker and packer system 5 according to the present invention, incorporating a pack opener and providing for in-line tobacco recovery and reclamation. FIG. 1*b* is a flow chart showing the flow of tobacco, cigarettes, cigarette packs and rejects in the cigarette maker and packer systems.

As shown in FIGS. 1*a* and 1*b*, tobacco is supplied to a cigarette rod making machine 20 by a hopper 10, which may be a PROTOS VE-80 model, manufactured by Hauni-Werke & Korber Co. KG, West Germany. The cigarette rod making machine 20 forms rods of smokable material, wrapped in a tube of cigarette paper. Properly formed rods are transported to a filter tipping machine 50, described below. "Long ends", which are produced during the startup of the rod making machine 20, and defective cigarette rods are manually removed by the operator and transported to a cigarette opener and tobacco removal unit 30, described below. Automatic transport means may also be provided.

The cigarette rod making machine 20 useful in carrying out this invention is of the type commercially available from Molins PLC, Great Britain or Hauni-Werke & Korber Co. KG and the use thereof is well-known to the skilled artisan. For example, a preferred cigarette rod making machine of the type known as a PROTOS 80 (commercially available from Hauni-Werke & Korber Co. KG) can be employed. A description of a PROTOS cigarette making machine is provided in U.S. Pat. No. 4,474,190 to Brand at col. 5, line 48 through col. 8, line 3, which is incorporated herein by reference. Other cigarette rod making machines, such as the PROTOS 100, manufactured by Hauni-Werke & Korber Co., KG and the Molins MK 10N, manufactured by Molins PLC, can also be employed.

The cigarette rod making machine 20 is directly coupled with the filter tipping machine 50, such as a MAX 80 commercially available from Hauni-Werke & Korber Co. KG, which affixes filters to the ends of the cigarette rods. If regular, non-filter cigarettes are to be made, no filter tipping machine is employed. Finished cigarettes are inspected and those meeting the appropriate quality standards are transported by conveyor 52 to cigarette storage and retrieval unit 60 which may be a model GDS90, manufactured by G. D. Societa per Azioni, Bologna, Italy. An alternative cigarette storage and retrieval unit 60 could be a System 88 available as OSCAR from Molins PLC. Defective cigarettes from the tipping machine 50 are transported automatically to cigarette opener and tobacco removal unit 30 by tipper belt conveyor 40.

From storage and retrieval unit 60, the cigarettes are transported via conveyor 62 to packer unit 70, which may be a model GDX-1 manufactured by G. D. Societa per Azioni. In lieu of a conveyer belt, cigarettes can be collected in cigarette trays (not shown), such as cigarette tray 82–86 mm available from Sasib as part no. P930203005F, and transported manually to the packer unit.

Individual cigarettes are packed typically 20 to a soft pack or crush-proof box with the cigarettes positioned in a 7-6-7 matrix. Other matrices may be used and the invention disclosed herein will accommodate such other matrices. After the cigarettes are packaged in individual packs, the cigarette packs are inspected and those found meeting the appropriate quality standards are transported to sealing film wrap and cartoner unit 90, which may be a model GD4350, manufactured by G. D. Societa per Azioni, where the packs are wrapped in a polymeric film, such as polyethylene or polypropylene, sealed and cartoned. Packs which are found defective in packer 70 are automatically transported by elevated conveyor 72 to pack opener unit 100. In addition, improperly cartoned or sealing film-wrapped packs can be transported manually (shown by dotted line 92, FIG. 1*a*) to the hopper (not shown) for pack opener unit 100, the operation of which is explained in detail below.

Individual cigarettes which for some reason were rejected or not properly packaged in the packer 70 are automatically transported back along conveyor 74 for further processing. Conveyor 74 is preferably a MAX 80 reject belt system manufactured by Hauni-Werke & Korber Co. Rejected packs are opened by pack opener 100, as described in greater detail hereinafter. The individual cigarettes extracted by pack opener 100 are also transported by conveyor 74 to cigarette opener and tobacco removal unit 30 for further processing. The flow of individual cigarettes on conveyor 74 is combined with the flow of individual cigarettes on conveyor 40 which were rejected in the filter tipping machine 50. The further processing of the combined flows of conveyors 74 and 40 includes the process of separating the tobacco from the filter and cigarette paper, as necessary. This process is accomplished in cigarette opener and tobacco removal unit 30, which may be a wet-belt type cigarette opening device, as, for example, a Niepmann-type HWR, manufactured by Niepmann GmbH, Gevelsburg, West Germany. Alternatively, the intact cigarettes could be inspected and those which are otherwise acceptable could be conveyed back to cigarette storage and retrieval unit 60, ultimately to be packed by packer unit 70.

The known Niepmann-type HWR separation unit 30 is a compact apparatus measuring approximately 1 meter by 1 meter by ¾ meter high. It is typically situated behind the cigarette rod making machine 20 and receives the rejects from the tipper 50 via tipper belt 40 which deposits them in a rotary vibrating feeder bowl on the Niepmann unit. The vibrating feeder bowl acts as a buffer and continuously outfeeds the cigarettes in-line at a constant output to the separation apparatus of the Niepmann unit. The Niepmann unit is characterized as a wet-belt cigarette opening device because cigarettes are first wetted on a small conveyor belt thereby creating a weakened strip in the paper along the bottom of each cigarette rod. The cigarettes are then passed through a grooved roller under pressure to break the paper along the weakened strip and then through rotary brushes that knock the tobacco from the cigarette rod leaving the filter intact with the cigarette paper attached to it. The loose tobacco, paper and filter are fed upwardly and across the top of the cigarette rod maker 20 over a screener with an approximately 8 millimeter mesh screen to remove the tobacco. The tobacco is deposited onto a trim-return feeding conveyor directly to hopper 10. The waste paper and filters are collected in a waste hopper 35, but, alternatively, could be collected in a central system. In order that the hopper 10 does not overflow, a gate 45 is provided at the entrance to the cigarette opener and tobacco removal device 30. This gate is lowered into place to stop the flow of cigarettes to be opened if the rod maker 20 is not operating, so that there is no accumulation of excess tobacco.

Power and controls are supplied to the entire system by electric cabinet 80.

As will be recognized by those skilled in the art, the individual elements of the system shown in FIGS. 1*a* and 1*b* are commercially available from a number of sources, with the exception, of course, of the pack opener 100. The addition of the pack opener 100 to such a system results in a unique combination of elements with a marked improvement in cigarette making efficiency and reduced wastage. This is because the addition of the pack opener 100 permits in-line reclamation of the tobacco and, as disclosed herein, properly configured, a system employing the pack opener 100 permits the option of reclamation of intact and otherwise acceptable cigarettes for recycling to the packer 70 without having the tobacco first removed from the individual cigarettes.

The method and system of the present invention has a number of important advantages. Among these are that the method and system are brand-specific, that is, the specific blend of tobacco used in making cigarettes is reclaimed and recycled directly back to the hopper containing that blend. The compactness of the components used results in low handling and hence low tobacco degradation and waste of the smokable material. Because the reclamation and recycling of tobacco is contemporaneous with the making of cigarettes and is relatively fast, moisture loss is low, resulting in no reconditioning of the tobacco being required. Thus, the reclaimed tobacco that is returned to the hopper has substantially the same predetermined moisture content as the tobacco in the hopper. Typical moisture content of tobacco filler material is 10 to 15%, preferably 12 to 13% during cigarette manufacture. Because of the relatively gentle nature of the pack opening and cigarette opening and tobacco removal components, the quantity of "shorts" is small. Finally, the method and system result in a high recovery rate of tobacco with at least 95% of the tobacco that is recovered from the cigarettes being returned to the hopper.

FIGS. 2–7 show various views of embodiments of pack opener apparatus which can be used in the system of the invention shown in FIGS. 1*a* and 1*b*. The method of pack opening and cigarette extraction used in the present invention includes the steps of removing at least one, but preferably both, of the end panels of a cigarette pack, followed by the application of a non-intrusive removal force to extract the cigarettes substantially intact from the pack. In order to perform these steps, the pack must be held and conveyed past devices for removing the end panels, such as rotating circular knives. The cigarette matrix is then loosened by applying a force which deforms the pack and tends to increase the cross-sectional area of the pack at least at one open end thereof, with a removal force being simultaneously or subsequently applied, such as a ]et of air, centrifugal force, the force of gravity, a mechanical force or combinations of those forces. The removal force is non-intrusive in that no apparatus or device is actually inserted into or otherwise enters the pack to remove the cigarettes therefrom. Pack deformation and cigarette removal can be performed by: (1) passing a pack opened at both ends through a converging chute or passage formed by the runs of a system of converging belts to deform the pack to increase the cigarette matrix cross-sectional area and then applying a jet of air to blow the cigarettes out of the pack; (2) rotating the opened pack in an arc through a converging chute or passage formed by a system of parallel rollers, thereby deforming the pack and applying centrifugal and gravity forces to eject the cigarettes from the pack; (3) rotating the opened pack in an arc through a converging chute or passage formed by a system of rollers and a rotating disk, thereby deforming the pack and applying centrifugal and gravity forces to eject the cigarettes from the pack; or (4) turning the pack so that at least one open end is oriented downwardly and deforming the pack by applying a vacuum to the front and back panels of the pack, thereby allowing the cigarettes to fall out of the pack under the force of gravity.

Figure 2:
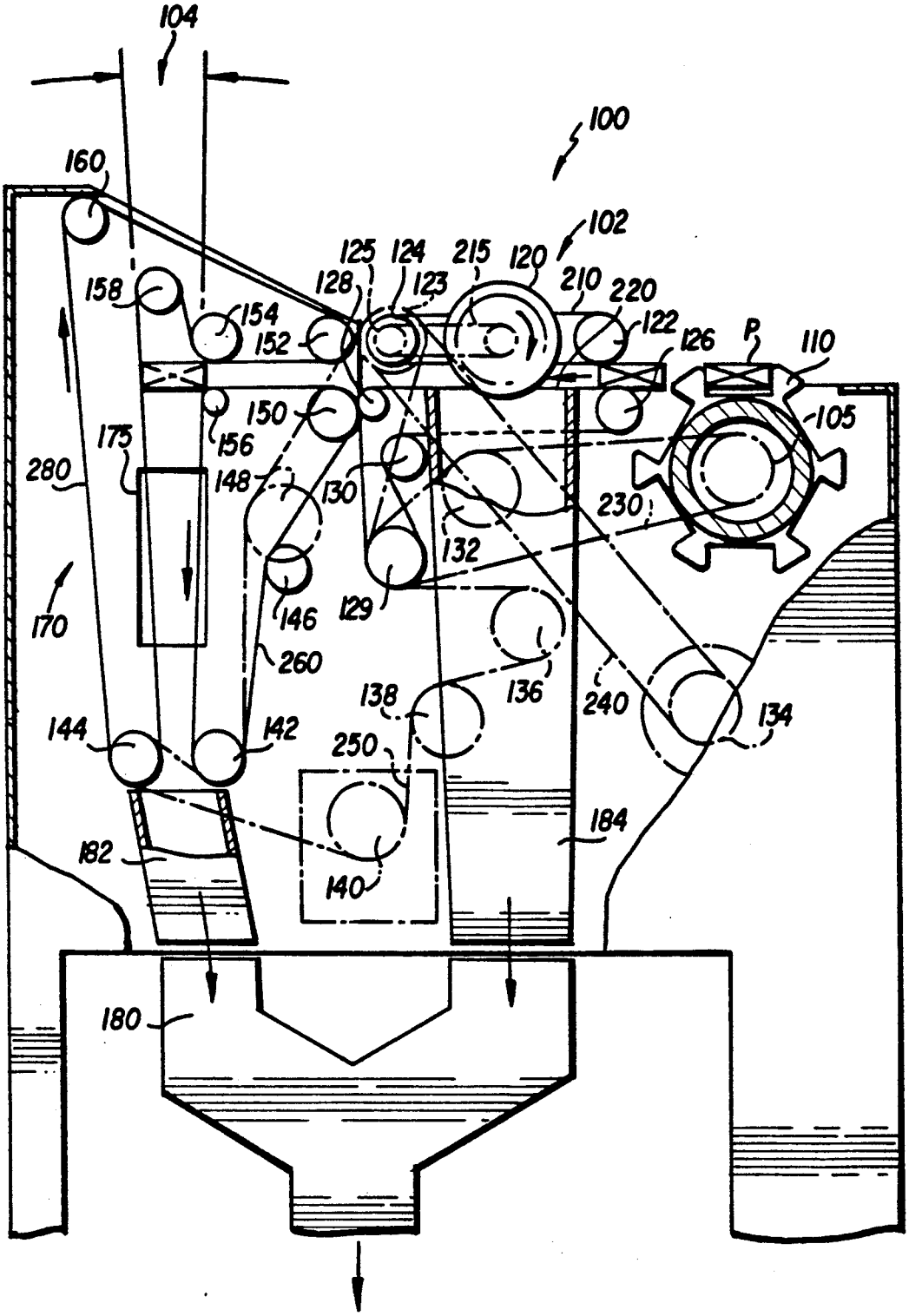
FIG. 2 is a side elevation view of a pack opener which incorporates a first embodiment of a pack opener stage and a first embodiment of a cigarette extraction stage.

FIG. 2 shows a side elevation view in partial fragmented section of pack opener unit 100. Pack opener 100 is one embodiment of the present invention, and comprises a pack opener stage 102 and a cigarette extraction stage 104, each stage including an arrangement of belts and pulleys. Although a specific belt and pulley arrangement is shown, along with the use of specific size and type belts, as well as specific drive motors, other pulleys, pulley arrangements, belts and motors, as known in the art, can be employed in the embodiments of the invention shown in FIGS. 2–7. FIG. 2 shows a first embodiment of the pack opener stage 102 using a pair of coaxially mounted circular knives 120 and a first embodiment of the extraction stage 104 employing a jet of air to extract cigarettes from a package of cigarettes after the end panels of the pack have been removed.

Pack P is conveyed (as discussed hereinafter in greater detail in reference to FIG. 3) by means of pick up slats attached to roller chains (not shown) to the top of the pack opener 100. Prior to being conveyed to the opener stage 102, pin pricks can be made on the sides of the pack by a known device (not shown) so as to keep the inner and outer members of the pack together. The pack is conveyed into engagement with indexing wheel 110, which is preferably a six lobe index wheel mounted on a six lobe wrap spring clutch (not shown). Indexing wheel 110 is formed from two parallel plates, approximately ⅜ inch thick, which straddle a support bridge. Indexing wheel 110 is rotated to deliver pack P to the conveyor means for rotating circular knife blades 120. The conveyor means comprises holddown belt 210 trained about pulleys 122, 124, and conveyor belt 220 trained about pulleys 126, 128, 129 and belt tensioner 130. Conveyor belt 220 and holddown belt 210 are preferably driven at identical speeds. Conveyor belt 220 is preferably a 0.050 inch thick, 1 ¾ inch wide flat belt; holddown belt 210 is preferably a 0.050 inch thick ⅜ inch wide flat belt.

Circular knife blades 120 are rotatably driven by a ½ horsepower 3450 rpm motor 134, via a timing belt 240, a ⅜ inch pitch, ½ inch wide belt, which drives pulley 125 and timing belt 215, a ⅜ inch pitch, ⅜ inch wide belt. The pack end panels, which are removed by circular knives 120, are vacuumed away by suction tube 184. The cigarette pack P with its two end panels removed by circular cutting knives 120 is transported to the extraction stage 104 by belts 220, 210. The extraction stage 104 comprises a pair of side-by-side extraction belts 280 each of which is a single-ply polyester/silicone-coated 0.050 inch thick, 1 ¼ inch wide belt and a separator belt 260 which is a single-ply polyester/silicone-coated 0.050 inch thick, 3 inch wide belt. Separator belt 260 and extraction belts 280 are driven at identical speeds which are preferably higher than the speed of holddown belt 210 and conveyor belt 220. Belts 280 are trained about pulleys 152, 154, 144 and 160 and belt tensioner 158. Belt 260 is trained about pulleys 150, 156 and 142 and is held in adjustment by belt tensioner 146. The main drive for the conveyor belt 220, holddown belt 210, separator belt 260, extraction belts 280 and indexing wheel 110 is provided by a ½ horsepower gear-head motor 140 which drives timing belt 250, a ⅜ inch pitch 1 inch wide double-sided belt which, in turn drives pulleys 129, 123, 142 and 144. Timing belt 230, a ⅜ inch pitch, 1 inch wide belt, is provided between pulley 129 and indexing wheel 110 to drive the latter. In addition to the conveying, holddown and extraction belt arrangements described above, alternative belt arrangements are contemplated. For example, there can be used pairs of opposed suction belts, each perforated, with a vacuum applied to the back of each belt.

Operation of the extraction stage 104 will now be described with reference to FIG. 2. When pack P passes pulleys 154 and 156 it falls under gravity and in contact with belts 280 and 260. The pulley arrangements result in belts 280 and belt 260 forming a converging vertical chute or passage, separated by the approximate width of a cigarette pack. The total preferred angular convergence is approximately 4° (although other angles of convergence could be used). This results in a squeezing or compression of the sides of the pack P as 0 it proceeds down the chute. Compression of the pack results in a distortion of the pack cross-section to a circular or oval configuration, thereby increasing the cross-sectional area so as to alter the cigarette pack matrix and render the cigarettes loose. As the pack traverses downwardly along the chute, it passes air extraction stage 170 comprised of a pair of air jet nozzles (shown at 300 in FIG. 3) such as WHISPER BLAST TM low pressure flat fan nozzles manufactured by Lechler, Inc., St. Charles, Illinois. At air extraction stage 170 air blasts from the nozzles push the individual cigarettes out of the packaging material. The combination of the minimal cross-sectional area of the pack edge and the friction between the belts 260, 280 and the sides of the pack prevents the pack material from being blown away with the cigarettes. The cigarettes are collected in air extraction stage 170 and transported for further processing. The pack, which is now empty, proceeds down between belts 260 and 280 to chute 182 from which it is drawn into suction duct 180.

A preferred velocity of the conveyor belt 220 and holddown belt 210 is 35 to 70 feet per minute (equivalent to approximately 200 to 400 packs per minute). The preferred velocity of the separator belt 260 and extraction belt 280 is approximately 1.2 times the conveyor and holddown belt velocity. The preferred cutting knife velocity is approximately 3400 rpm. Other belt and blade velocities are contemplated within the scope of the present invention. The air flow through the nozzles 300 is preferably around 6 scfm at 15 to 20 psi, although other flows are contemplated.

Circular knives 120 are shown in FIG. 2 as coaxially mounted on a common shaft. Preferably, the knives are axially adjustable so that the spacing between them can be varied. This permits the removal of end panels from various length cigarette packs. Also, the spacing between the knives can be adjusted so that the end panel away from the filter is removed and a cut is made through the pack at the joint between the cigarette rods and filters. Such an arrangement permits the removal of the filter elements at the opener stage and the vacuuming away by vacuum chute 184 of the end panel, filters and pack material, (including the end panel) covering the filters.

Figure 3:
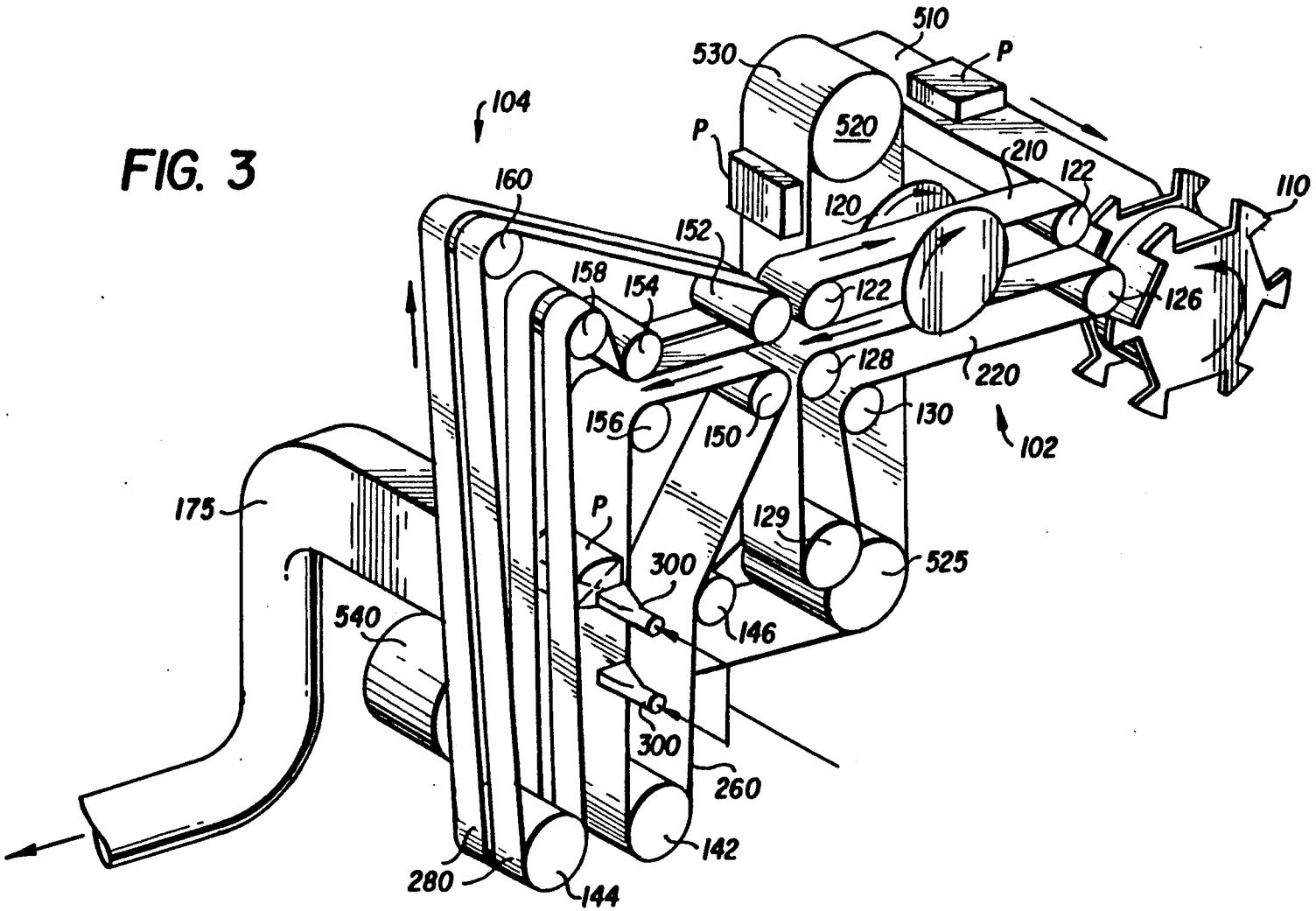
FIG. 3 is a perspective diagram of a first embodiment of the pack opener stage and a first embodiment of an extraction stage.

FIG. 3 shows in perspective diagrammatic form the conveyance of cigarette packs to be opened, the first embodiment of the opening stage 102 and the first embodiment of the extraction stage 104 using the air ]et extraction technique. As shown in FIG. 3, index assembly 530 comprised of pick up slats attached to 510 (a 1 ¾ inch wide, 0.050 inch thick flat belt), which in turn conveys the packs to indexing wheel 110. From there each pack is aligned by pack guides (not shown) and is fed into the opener stage between belts 210 and 220. The actuation of indexing wheel 110 and the feeding of the pack into the opener stage can be regulated by a proximity switch (not shown) which actuates the six lobe wrap spring clutch (also not shown). The belts 210 and 220 carry pack P to rotating knives 120 which remove the end panels of the cigarette pack. The removed end panels are vacuumed off by vacuum chute 184 (see FIG. 2). The cigarette pack, which has both end panels removed (or alternatively, the end panels and filters removed, as described above) is conveyed by belts 210 and 220 to the extraction stage 104 where cigarette extraction is performed using belt 260 and parallel belts 280. The pulley arrangement for the belts 260, 280 provides the convergence discussed previously in connection with FIG. 2. This results in the compression and deformation of the pack P as shown in FIG. 3. Jets of air are provided by air jet nozzles 300 which provide an essentially planar air ]et which blows the cigarettes into duct 175, through which they are transported for further processing.

Figures 4A, 4B:
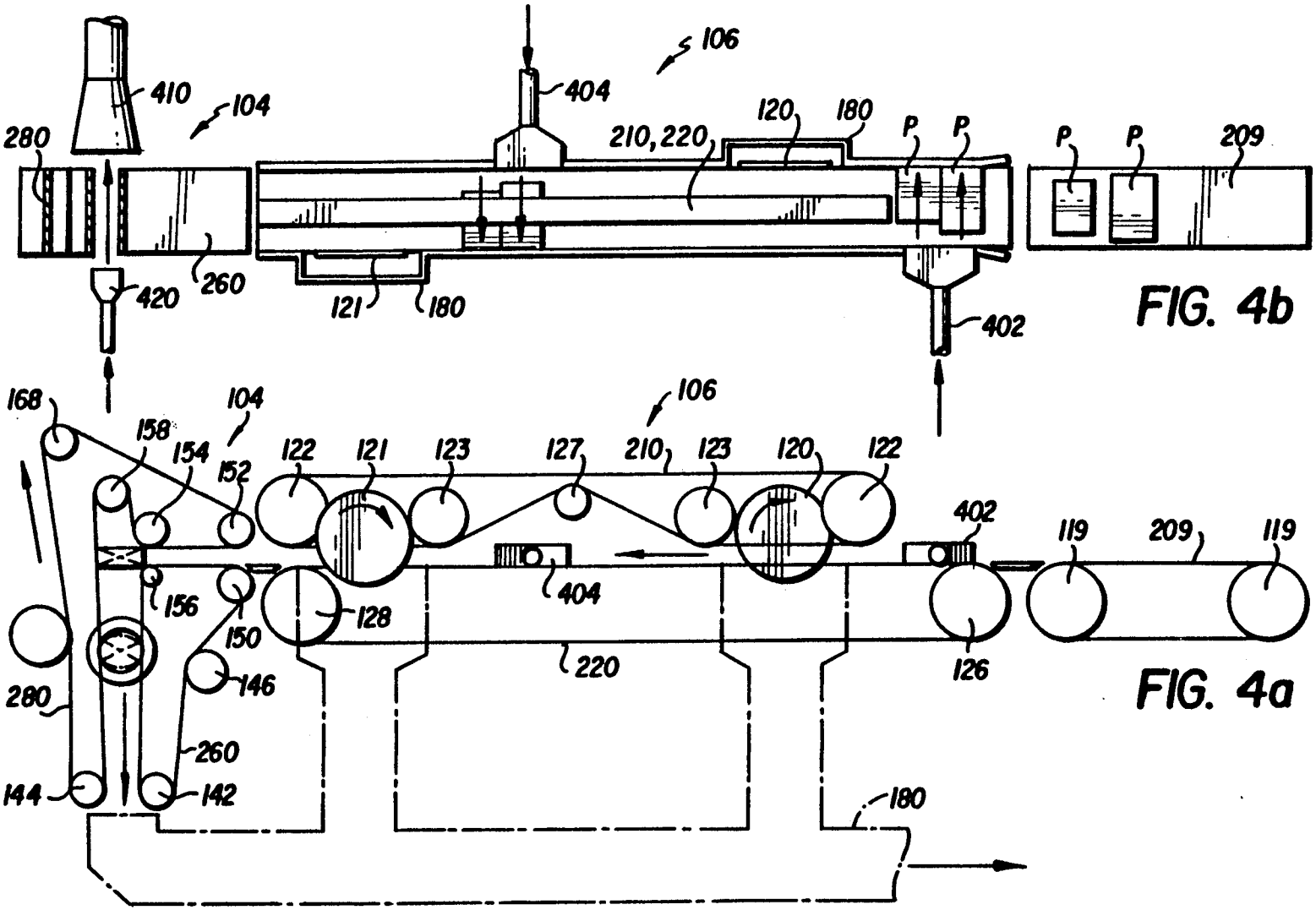
FIG. 4*a* is a side elevation view of a second embodiment of the pack opener stage shown with the first embodiment of the extraction stage.
FIG. 4*b* is a top plan view of the second embodiment of the pack opener stage and the first embodiment of the extraction stage shown in FIG. 4*a*.
Figure 4C:
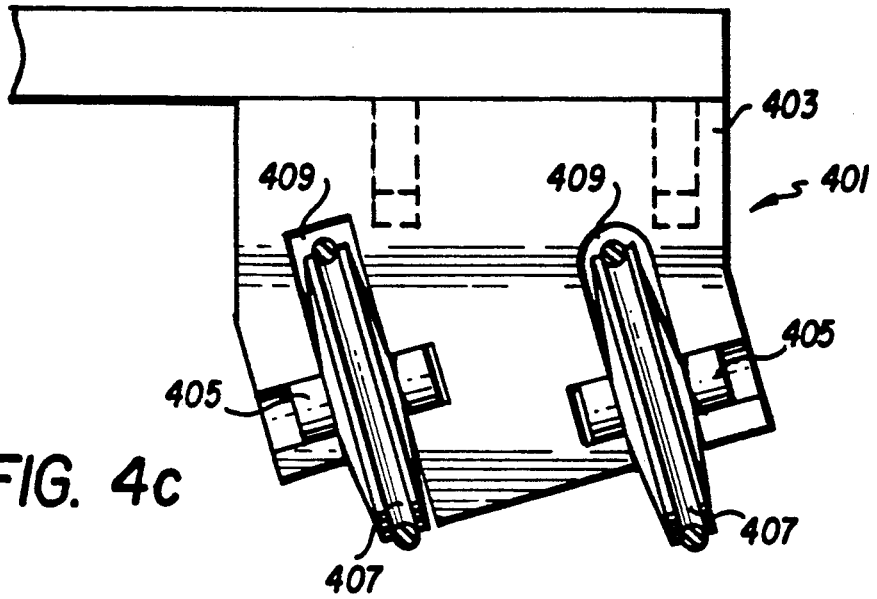
FIG. 4*c* is a bottom plan view of a mechanical guide used in the second embodiment of the pack opener stage.

FIGS. 4*a*, 4*b* and 4*c* illustrate a second embodiment of the opener stage 106, in which knife blades 120 and 121 are not mounted coaxially, but rather are oppositely mounted in staggered serial fashion. This permits ready opening of different sized packs of cigarettes without adjusting the spacing between the knives, as will be explained below. Referring to FIG. 4*b*, packs P are conveyed to the opening stage 106 as explained before. Opener stage 106 includes holddown belt 210, trained about pulleys 122, 123 and belt tensioner 127, conveyor belt 220, trained about pulleys 126 and 128, and circular knives 120 and 121. In the opener stage, but prior to engagement of the packs by the belts 210, 220, air jet shuttle nozzle 402 (which is preferably a WHISPER BLAST TM fan nozzle) is used to push or shuttle the packs P transversely relative to belts 210 and 220. Alternatively, the shuttle operation can be performed by a brushing apparatus or mechanical guides. The packs then pass circular knife 120 where one end panel is removed. The removed end panel is then vacuumed away through duct 180 and the packs proceed in the direction of belt movement. Upon passing air jet shuttle nozzle 404 (similar to nozzle 402) which is mounted on the opposite side of belt 220 from shuttle nozzle 402, and downstream thereof, the packs with the severed end are pushed to the opposite side and the other end panel is removed at circular knife 121. It will be appreciate that the location of the cutting knives can be altered to permit severance of the filter element from the cigarettes, as previously described.

FIG. 4*c* illustrates a mechanical guide 401 which can be used to shuttle the packs transversely to the belt. Guide 401 includes guide holder 403, having recesses 409 therein, in which guide wheels 407 are mounted to rotate about shafts 405. The wheels 407 are mounted to be at an angle to the path of the belt travel so as to urge the packs to one or the other side of the conveyor. A pair of guides is used spaced apart along the belt, in place of the shuttle nozzles, each having one or more guide wheels, with the wheels oriented so as to direct the packs in the proper transverse direction. FIGS. 4*a* and 4*b* illustrate the first embodiment of the air jet extraction stage 104 downstream from the second opening stage embodiment. However, other extraction stages described hereinafter could be employed in lieu of the air jet extraction stage 104.

Figure 5A:
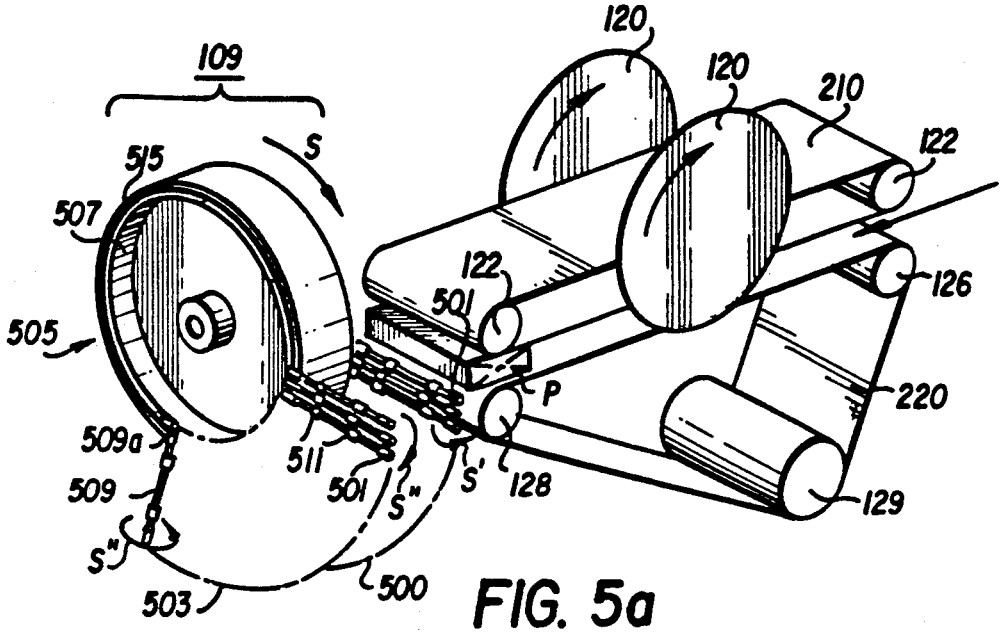
FIG. 5*a* is a perspective diagram of the first embodiment of the pack opener stage and a second embodiment of the extraction stage.
Figure 5C:
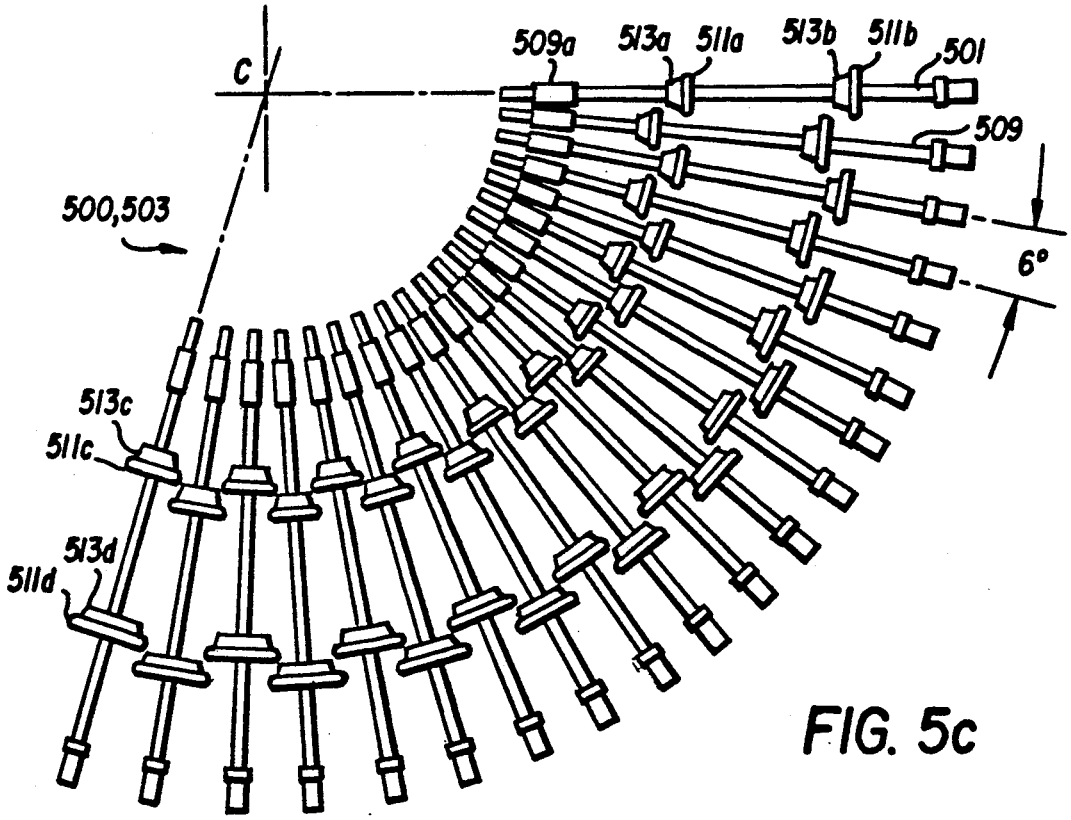
FIG. 5*c* is a side elevation view of the roller series of the second extraction stage embodiment.
Figure 5B:
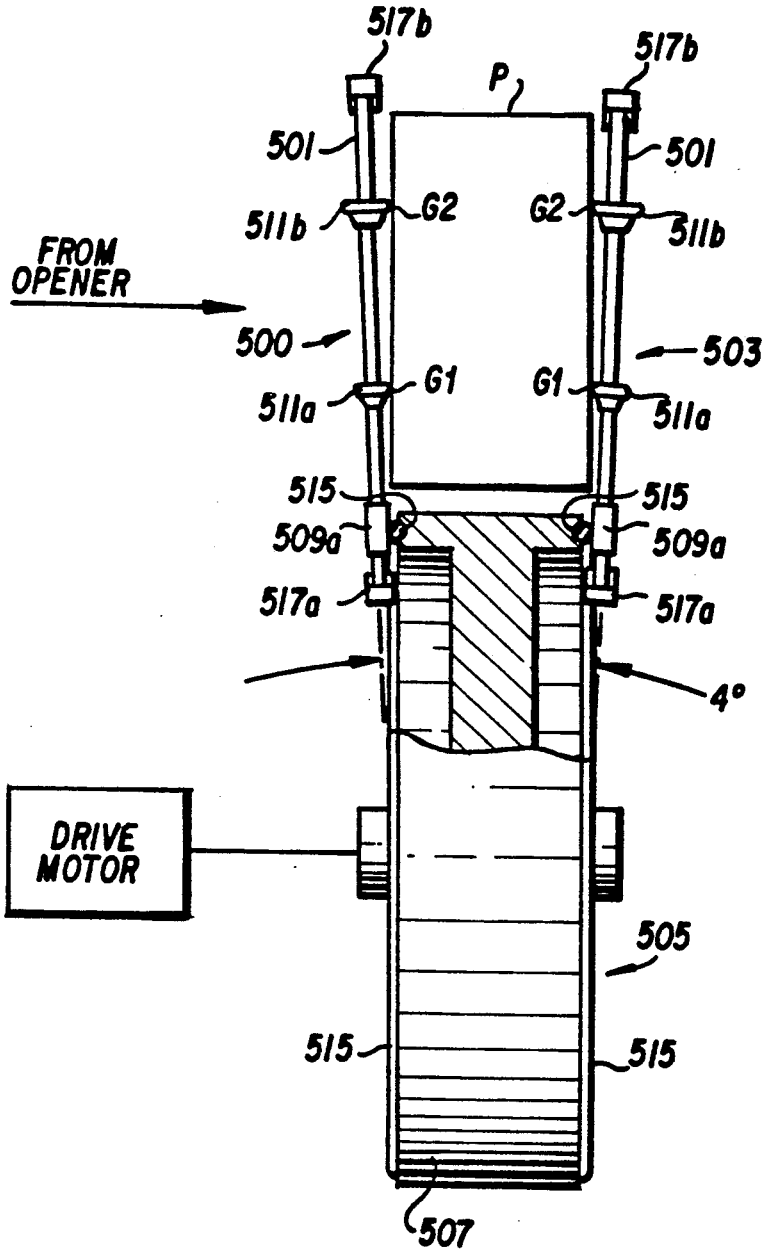
FIG. 5*b* is a top plan view of the roller series and drive wheel of the second extraction stage embodiment.

FIGS. 5*a*, 5*b* and 5*c* diagrammatically illustrate a second embodiment of the extraction stage of the invention in conjunction with an opener stage. Coaxially mounted circular knives 120 are illustrated with belts 210 and 220 which have a different pulley arrangement than the embodiment of FIG. 2. The specific pulley arrangement is not necessary to the invention, and is shown solely for illustrative purposes. A serial knife arrangement similar to FIGS. 4*a* and 4*b* could also be employed.

The second embodiment of the extraction stage shown in FIGS. 5*a*–5*c* involves structural elements performing two functions: (1) the gripping of a cigarette pack and rotation of the pack through an arc and (2) the squeezing of the sides of the pack to loosen the cigarette matrix. As shown in FIG. 5*a*, a centrifugal extraction stage 109 is comprised of two series of rollers 500, 503, with the rollers of each series mounted relative to one another over an arc exceeding 90°.

FIG. 5*b* depicts a top plan view of the two series of rollers 500, 503 as they grip cigarette pack P. FIG. 5*b* shows the first roller 501 in each series 500, 503. Pack P is gripped by O-rings 511*a* and 511*b* at the four points G1, G2 shown. The longitudinal axes of the rollers 501 are aligned at an acute angle, preferably approximately 4°. Knurled surfaces 509*a* frictionally contact O-rings 515 attached to the beveled rim 507 of a drive wheel 505, which is driven by an electric motor. The ends of each roller are mounted in a journaled bracket, depicted as 517*a*, 517*b*. The alignment of the rollers 501 at the small acute angle shown is necessary in order to grip the pack P and move it through an arc. This is because, in moving though an arc, the points G1 of the pack P gripped by O-rings 511*a* must move at the same angular velocity as the points G2 gripped by O-rings 511*b*. The linear velocities at O-rings 511*b* must be higher than those at 511*a*, so the O-rings 511*b* have a larger diameter. The combination of the alignment of the rollers and the different diameter O-rings results in the small acute angle between the longitudinal axes of the corresponding opposing rollers, as shown in FIG. 5*b*.

As illustrated in FIGS. 5*a* and 5*b*, the driven ends of each roller are in contact with the drive wheel 505, with the longitudinal axis of each roller lying on a surface which defines an arcuate sector of a frustum of a very shallow cone, e.g. preferably having a base angle of approximately 2°. The conical surfaces defined by the longitudinal axes of the rollers of roller series 500 and 503 are essentially transverse to the plane of belt 210, with a resulting small angular convergence (e.g. preferably about 4°) toward a vertex generally in the same direction in which the roller axes intersect (shown as point C, FIG. 5*c*). It is contemplated that, in a typical arrangement, twenty (20) rollers, with the longitudinal axis of each oriented 6° relative to the other and converging at point C (the apex of the shallow cone), would be used in each series. Of course, other combinations of roller numbers and angular arrangements could be used.

As shown in FIG. 5*c*, depicting a roller series, the two roller series 500 and 503 are each made up of a plurality of rollers 509, arranged in a fan-shaped arc exceeding 90 degrees. This fan-shaped arc is supported by the journaled bracket described above. In order to maintain contact with the drive wheel 505 (shown in FIGS. 5*a* and 5*b*), the longitudinal axes of the rollers in each respective series are substantially on a surface which defines an arcuate sector of the frustum of a shallow cone. Each roller 509 has a knurled surface 509*a* located near its convergent end. The pack gripping surfaces of each roller comprise two O-rings 511*a* and 511*b* (preferably of silicone rubber) having different diameters and mounted on O-ring mounts 513*a* and 513*b* along each roller, such that the surface velocities of the O-rings are proportional to their respective radii from convergence point C, thereby simulating a tapered roller. In addition, as shown in FIG. 5*c*, the O-rings on each series of rollers increase 0.020 inch in diameter for each angular increment, as shown by the different sizes of 511*a* and 511*b* and their respective mounts 513*a* and 513*b* compared to 511*c* and 511*d* and their respective mounts 513*c* and 513*d*. The increasing diameter O-rings along the path of travel squeeze the sides of the pack P as it traverses the passage between roller series.

Referring again to FIG. 5*a*, pack P with both ends of the pack removed, is transported by belts 210 and 220 to centrifugal extraction stage 109. The first roller 501 in each series of rollers 500, 503 is arranged with its gripping surface periphery, explained above, almost parallel to the plane of belt 220, so that the packs P are discharged smoothly into the centrifugal extraction stage 109. Each roller thereafter is oriented at a downward inclination from roller 501 a fixed number of degrees, until the final roller in the sequence is oriented in excess of 90° relative to the first roller. Upon leaving the space between belts 210 and 220, pack P enters the space between the roller series 500 and 503, which is initially approximately the width of a cigarette pack, but converges, as described above. Drive wheel 505 is rotated in the direction shown by the arrow S, i.e., clockwise as viewed in FIG. 5*a*, which, in turn, rotates the rollers 509 in series 500 in the direction shown by arrow S′ and the rollers 509 in series 503 in the direction shown by arrow S,, Typical rotation speeds of the drive wheel 505 are 100 to 200 rpm.

Upon entering the space between the roller series 500 and 503, the pack is gripped between the rollers 509 of each series 500 and 503. As a result of the convergence between the roller gripping surfaces caused by the increasing O-ring diameters along the path of travel, the pack is compressed approximately 10 mm through 90° of rotation and the cross-sectional area thereof is increased. The rollers accelerate the pack, thereby imparting a centrifugal force to the pack and contents thereof. Thus, the cigarette matrix is altered and loosened by the compression of the pack, and the centrifugal force imparted to the pack by the rollers, together with the force of gravity, results in the now loosened cigarettes being expelled from the pack in a downward and outward direction so that when a pack reaches a vertical position all cigarettes have been expelled. The centrifugal force applied to the cigarettes is approximately 1 to 4 g. The expelled cigarettes can be collected in a duct or otherwise conveyed for further processing. The empty pack is vacuumed away as before.

Figures 6, 7A:
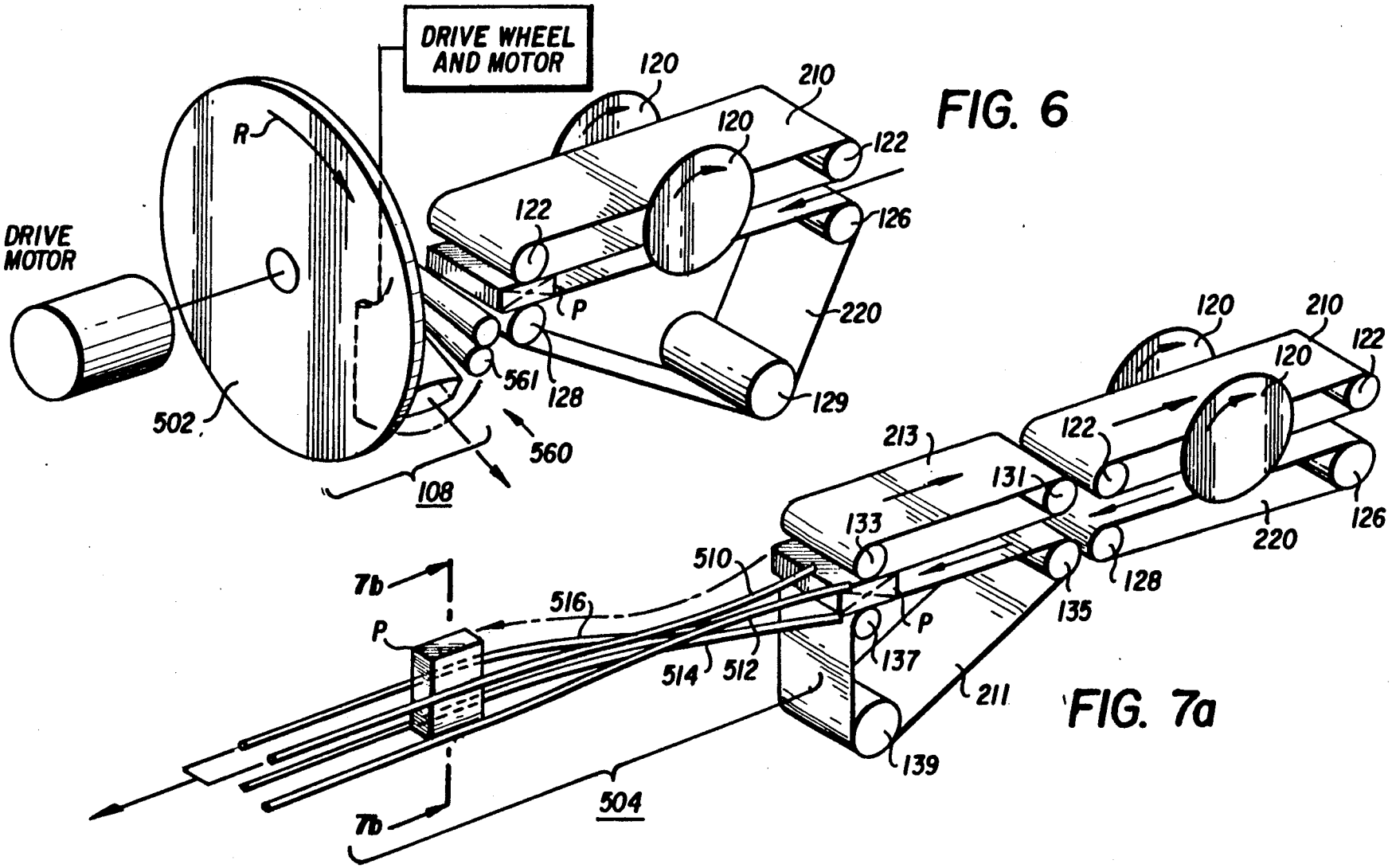
FIG. 6 is a perspective diagram of the first embodiment of the pack opener stage and a third embodiment of the extraction stage.
FIG. 7*a* is a perspective diagram of the first embodiment of the pack opener stage and a fourth embodiment of the extraction stage.

FIG. 6 diagrammatically illustrates a third embodiment of the extraction stage of the invention in conjunction with an opener stage. This is an alternative centrifugal embodiment. The opener stage is the same as for the previous extraction stage embodiment, although a serial knife arrangement similar to FIGS. 4*a* and 4*b* could also be employed.

In the third embodiment of the extraction stage, pack P with both ends of the pack removed, is transported by belts 210 and 220 to centrifugal extraction stage 108. Centrifugal extraction stage 108 is comprised of a circular rotating disk 502 and a series of rollers 560, having tapered gripping surfaces, which are angularly mounted relative to one another over an arc exceeding 90°, with the longitudinal axis of each roller lying in a plane. The first roller 561 is arranged with its periphery parallel to the plane of belt 220, so that the packs P are discharged smoothly into the centrifugal extraction stage 108. Each roller thereafter is oriented at a downward inclination from roller 561 a fixed number of degrees, until the final roller in the sequence is oriented in excess of 90. relative to the first roller. The plane of the roller series 560 is essentially at right angles to the plane of belt 210. It is contemplated that, in a typical arrangement, twenty (20) rollers will be used with the longitudinal axis of each roller oriented 6° relative to the next adjacent rollers. As before, other combinations of roller numbers and angular arrangements could be used. The drive of the single series of rollers is also by means of a drive wheel (not shown) similar to drive wheel 505, as described above in connection with FIGS. 5*a*, 5*b* and 5*c*.

Upon exiting the space between belts 210 and 220, pack P enters the space between the roller series 560 and circular disk 502, which is approximately the width of a cigarette pack. The planes of the disk 502 and roller series 560 converge toward one another at an angle of about 4°, although other angles of convergence may be employed. Disk 502 is rotated in the direction shown by the arrow R, i.e., clockwise as viewed in FIG. 6. Typical rotation speeds of the disk 502 are 100 to 200 rpm. The disk 502 can be made of any rigid material, preferably a metal, such as steel, coated with silicone rubber on the extraction contact side, or it can be made of a semi-rigid material, such as a "floppy disk" material which is substantially rigid when rotated. Upon entering the space between the disk 502 and roller series 560 the pack is gripped between the roller series 560 and the disk 502. As a result of the 5 convergence between the disk and rollers, the pack is compressed and the cross-sectional area thereof is increased. The cigarette matrix is thus altered and loosened, and the centrifugal force imparted to the pack by the disk and rollers, together with the force of gravity, results in the cigarettes being expelled from the pack in a downward and outward direction so that when a pack reaches a vertical position all cigarettes have been expelled. The centrifugal force applied to the cigarettes is approximately 1 to 4 g. The expelled cigarettes can be collected in a duct or otherwise conveyed for further processing. The empty pack is vacuumed away as described in connection with the previous embodiments.

Figure 7B:
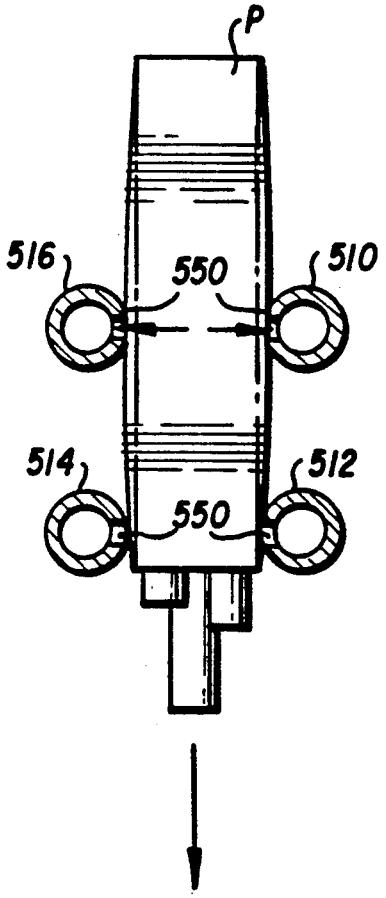
FIG. 7*b* is a sectional view of the extraction stage of FIG. 7*a* taken along line A—A of FIG. 7*a*.

FIGS. 7*a* and 7*b* show a fourth embodiment of the invention as it relates to the cigarette extraction. As before, both end panels of the pack are removed at the opener stage comprising holddown belt 210, conveyor belt 220 and rotating circular knives 120. In the extraction stage of this embodiment, belt 211 trained about pulleys 135, 137 and 139, and belt 213 trained about pulleys 131 and 133, convey the pack P to a pack turner assembly 504 comprising four tubular rods, 510, 512, 514, and 516, each having a plurality of holes 550 running along the sides thereof confronting the pack P. A vacuum is applied to each of the tubular rods 510, 512, 514, and 516, resulting in suction through holes 550. Additional belts (not shown) preferably arranged parallel to the tubular rods, grip the front and back panels of the packs and carry them along the pack turner assembly 504. As a pack P is conveyed between the pack turner assembly, it is reoriented from the horizontal to the vertical position, suction is applied through holes 550 to the front and back panels of the pack, thereby expanding it slightly. As a result, the cross-sectional area of the pack is increased, the cigarette matrix is altered and loosened and the cigarettes drop from the pack under the force of gravity.

It is contemplated that with the second and third extraction embodiments (centrifugal force) and the fourth extraction embodiment (gravity), cigarettes may be removed from a pack having only one end panel cut away and with the pack oriented such that the open end faces outwardly for centrifugal extraction or downwardly for gravity extraction.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law

What is claimed is:

1. A cigarette making and packaging apparatus comprising:

(a) means for supplying a smokable material;

(b) means for making cigarettes from the smokable material;

(c) means for packaging the cigarettes in packs;

(d) means associated with said packaging means for rejecting defective cigarette packs;

(e) means for opening defective packs and removing the cigarettes therefrom, wherein each said pack has two ends and a cross-sectional area, said two ends and cross-sectional area being transverse to the longitudinal axes of the cigarettes in the pack, said pack opening and cigarette removing means comprising:

(i) means for opening at least one of said two ends of the pack;

(ii) means for deforming the pack so as to increase the transverse cross-sectional area thereof;

(iii) means for extracting the cigarettes from the pack through the open end thereof;

(f) means for transporting the defective packs from the rejecting means to the pack opening and cigarette removing means;

(g) means for removing the smokable material from the cigarettes;

(h) means for transporting the cigarettes from the pack opening and cigarette removing means to the smokable material removing means; and (i) means for returning the smokable material removed from the cigarettes to the means for supplying smokable material.

2. The apparatus of claim 1, wherein the cigarettes comprise cigarette paper wrapping the smokable material and wherein the means for removing the smokable material from the cigarettes comprises:

(a) buffer means for arranging cigarettes in-line;
(b) means for weakening cigarette paper along the cigarette longitudinal axis;
(c) means for applying pressure to the cigarettes, thereby breaking the weakened paper; and
(d) brush means for separating the smokable material from the cigarettes.

3. The apparatus of claim 1, wherein the means for making cigarettes further comprises means for affixing cigarette filters to the ends of the cigarettes.

4. The apparatus of claim 1, further comprising means for rejecting defective cigarettes, means for combining the defective cigarettes with the cigarettes removed from the defective packs, and means for transporting the combined cigarettes to said smokable material removing means.

5. The apparatus of claim 1, wherein said means for opening defective packs and removing the cigarettes therefrom includes means for opening both ends of each pack.

6. A method for making and packaging cigarettes comprising the steps of:

(a) supplying a smokable material for making cigarettes;
(b) making cigarettes of the smokable material;
(c) packaging the cigarettes in packs, wherein each said pack has two ends and a cross-sectional area, said two ends and cross-sectional area being transverse to the longitudinal axes of the cigarettes in the pack;
(d) rejecting defective cigarette packs;
(e) removing the cigarettes from each defective cigarette pack by opening at least one of said two ends of the pack, deforming the pack so as to increase the transverse cross-sectional area thereof, and extracting the cigarettes from the pack through the open end thereof;
(f) removing the smokable material from the cigarettes; and
(g) returning the smokable material removed from the cigarettes to the smokable material supplying step.

7. The method of claim 6, whereby the cigarettes have cigarette paper wrapping the smokable material and whereby the step of removing the smokable material from the cigarettes comprises the steps of:

(a) arranging the cigarettes in-line;
(b) weakening the cigarette paper along the cigarette longitudinal axis;
(c) applying pressure to the cigarettes, thereby breaking the weakened paper; and
(d) brushing the smokable material from the cigarettes.

8. The method of claim 6, for making cigarettes having filters attached thereto, whereby step (b) further includes affixing cigarette filters to the ends of the cigarettes.

9. The method of claim 6, further comprising the steps of rejecting defective cigarettes, combining the defective cigarettes with the cigarettes removed from packs, and transporting the combined cigarettes to said smokable material removing step.

10. The method of claim 6, whereby the step of removing the cigarettes from the defective cigarette packs includes opening both ends of each pack.

11. Apparatus for removing cigarettes from a cigarette pack having a front, a rear, two sides, two ends and a cross-sectional area, said two ends and cross-sectional area being transverse to the longitudinal axes of the cigarettes in the pack, comprising:

(a) means for opening at least one of said two ends of the pack;
(b) means for deforming the pack so as to increase the transverse cross-sectional area thereof; and
(c) means for extracting the cigarettes from the pack through the open end thereof.

12. Apparatus as in claim 11, wherein said end opening means comprises means for cutting off both ends of the pack.

13. Apparatus as in claim 11, wherein said end opening means comprises knife means for cutting off said one end of the pack.

14. Apparatus as in claim 11, wherein said end opening means comprises knife means for cutting off both ends of the pack.

15. Apparatus as in claim 14, wherein said knife means comprises a pair of coaxially mounted circular knives.

16. Apparatus as in claim 14, wherein said knife means comprises a pair of rotatable circular knives mounted in staggered serial fashion relative to each other, means for conveying the cigarette pack from one knife to the other, and shuttle means for moving the pack from one knife to the other transversely to the direction of conveyance.

17. Apparatus as in claim 16, wherein said shuttle means comprises a pair of air ]et nozzles mounted in staggered serial fashion relative to each other, with each said nozzle mounted, in the direction of conveyance, upstream and across from a circular knife.

18. Apparatus as in claim 16, wherein said shuttle means comprises a pair of guides mounted in staggered serial fashion relative to each other, said guides comprising a holder having a cavity thereon, at least one wheel rotatably disposed in said cavity, said wheel aligned to direct the pack toward a circular knife, each said guide mounted in the direction of conveyance, upstream from a circular knife.

19. Apparatus as in claim 11, wherein said means for opening at least one end of the pack includes means for opening both ends of the pack, said means for deforming the pack comprises belt means for gripping and deforming the pack and said extracting means comprises air jet means for blowing the cigarettes from the deformed pack.

20. Apparatus as in claim 11, wherein said means for deforming the pack and said means for extracting cigarettes from the open pack end comprises:

(a) roller means comprising a plurality of rollers disposed substantially in a plane and at angular intervals relative to one another for imparting a centrifugal force to the pack;
(b) disk means rotatable about its centroidal axis for imparting centrifugal force to the pack;
(c) said disk means disposed at a small converging angle to the plane of said roller means;
(d) drive means for rotating said disk means and roller means so as to impart the centrifugal force to the pack; and
(e) said disk means and said roller means positioned relative to each other to grip the opposite sides of the pack, deform the pack cross-section and loosen the cigarettes such that the centrifugal force imparted to the pack by the disk means and the roller means extracts cigarettes from an open end thereof.

21. Apparatus as in claim 11, wherein said means for deforming the pack and said means for extracting cigarettes from the open pack end comprises:

(a) first roller means comprising a plurality of first rollers having their longitudinal axes disposed substantially along a surface and at angular intervals relative to one another, each of said first rollers having a driven end;

(b) second roller means comprising a plurality of second rollers having their longitudinal axes disposed substantially along a surface and at angular intervals relative to one another, each of said second rollers having a driven end;

(c) the surface of said first roller means disposed at a small converging angle relative to the surface of said second roller means;

(d) gripping surface means, mounted on said first and second roller means, for gripping a cigarette pack, said gripping surface means forming a convergent passage in the direction of pack travel;

(e) said first and second roller means positioned relative to each other to grip the opposite sides of the pack, thereby deforming the pack cross-section and loosening the cigarettes;

(f) drive means, disposed at the driven ends of said first and second rollers, for rotating said first and second rollers in opposite directions, thereby imparting centrifugal force to the pack;

whereby the centrifugal force applied to the pack extracts cigarettes from an open end thereof.

22. Apparatus as in claim 11, wherein said means for deforming the pack and said means for extracting the cigarettes from the open pack end comprises pack turner means for orienting the pack vertically with the open end thereof facing downwardly, said pack turner means including means for gripping the pack at its front and rear, to increase the pack cross-sectional area, thereby permitting the cigarettes to fall from the pack under the force of gravity.

23. An apparatus for making and packing cigarettes having smokable material reclamation capabilities, comprising:

(a) means for making cigarette rods from smokable material filler;

(b) means for affixing filters to said cigarette rods to make finished cigarettes, said filter affixing means communicating with said cigarette rod making means;

(c) means for storing and retrieving finished cigarettes communicating with said filter fixing means;

(d) means, communicating with said storing and retrieving means, for packing said finished cigarettes in cigarette packs, the packs having a cross-sectional area transverse to the longitudinal axes of the cigarettes in the pack;

(e) means for wrapping said cigarette packs in a polymeric film;

(f) means for packing said packs in cartons;

(g) means for rejecting cigarette packs, communicating with said means for packing cigarettes in packs, said means for wrapping cigarette packs and said means for packing packs in cartons;

(h) means for opening cigarette packs, communicating with said cigarette pack rejecting means, said pack opening means accepting rejected cigarette packs;

(i) said cigarette pack opening means having means for opening at least one end of each rejected cigarette pack, means for deforming the pack so as to increase the transverse cross-sectional area thereof, and means for extracting the cigarettes from the pack through the open end thereof;

(j) smokable material reclamation means for separating smokable material filler from cigarettes, said reclamation means communicating with said pack opening means; and (k) means for transporting said reclaimed smokable material filler to said means for making cigarette rods.

24. An apparatus as in claim 23, wherein the cigarettes comprise cigarette paper wrapping the smokable material filler and wherein the smokable material reclamation means comprises:

(a) buffer means for arranging cigarettes in-line;

(b) means for weakening the cigarette paper along the cigarette longitudinal axis;

(c) means for applying pressure to the cigarettes, thereby breaking the weakened paper; and (d) brush means for separating the smokable material from the cigarettes.

25. A cigarette making and packaging apparatus comprising:

(a) means for supplying a smokable material;

(b) means for making cigarettes from the smokable material, including means for wrapping the smokable material in cigarette paper;

(c) means for rejecting defective cigarettes;

(d) means for packaging the cigarettes in packs;

(e) means associated with said packaging means (g) means for transporting the defective packs from the rejecting means to the pack opening and cigarette removing means;

(h) means for removing the smokable material from the cigarettes, comprising (i) buffer means for arranging cigarettes in-line;

(ii) means for weakening the cigarette paper along the longitudinal axis of each cigarette;

(iii) means for applying pressure to each cigarette, thereby breaking the weakened paper; and (iv) brush means for separating the smokable material from the cigarettes;

(i) means for transporting defective cigarettes to said smokable material removing means;

(j) means for transporting the cigarettes from the pack opening and cigarette removing means to said smokable material removing means; and (k) means for returning the smokable material removed from the cigarettes to the means for supplying smokable material.

26. The apparatus of claim 25, further comprising means for affixing cigarette filters to the ends of the cigarettes.

27. A method for making and packaging cigarettes comprising the steps of:

(a) supplying a smokable material for making cigarettes;

(b) making cigarettes of the smokable material by wrapping the smokable material in cigarette paper;

(c) rejecting defective cigarettes;

(d) packaging the cigarettes in packs;

(e) rejecting defective cigarette packs;

(f) opening defective cigarette packs;

(g) non-intrusively removing the cigarettes from the defective cigarette packs;

(h) removing the smokable material from the defective cigarettes and the cigarettes removed from the defective packs by
(i) arranging the cigarettes in-line;
(ii) weakening the cigarette paper of each cigarette along the longitudinal axis thereof;
(iii) applying pressure to the cigarettes, thereby breaking the weakened paper; and
(iv) brushing the smokable material from the cigarettes; and
(i) returning the smokable material removed from the cigarettes to the smokable material supplying step.

28. The method of claim 27, whereby step (g) further includes opening at least one end of the pack, deforming the pack so as to increase the cross-sectional area thereof, and extracting the cigarettes from the pack through the open end thereof.

29. The method of claim 27 for making cigarettes having filters attached thereto, whereby step (b) further includes affixing cigarette filters to the ends of the cigarettes.

30. The method of claim 27, further comprising transporting the defective cigarettes from step (c) and the cigarettes removed from the defective packs from step (g) for removal of the smokable material therefrom in step (h).

31. The method of claim 27 in which the smokable material has a predetermined moisture content, whereby the moisture content of the smokable material returned at step (i) is substantially the same as the moisture content of the smokable material at step (a).

32. The method of claim 27, whereby in step (i) at least 95% of the smokable material removed at step (h) is returned to the smokable material supply step.

33. An apparatus for making and packing cigarettes, with smokable material reclamation, comprising:
(a) means for making cigarette rods from smokable material filler by wrapping the smokable material filler in cigarette paper;
(b) means for affixing filters to said cigarette rods to make finished cigarettes, said filter affixing means communicating with said cigarette rod making means;
(c) means for rejecting defective cigarettes;
(d) means for storing and retrieving finished cigarettes communicating with said filter affixing means;
(e) means, communicating with said storing and retrieving means, for packing said finished cigarettes in cigarette packs, the packs having a cross-sectional area transverse to the longitudinal axes of the cigarettes in the pack;
(f) means for wrapping said cigarette packs in a polymeric film;
(g) means for packing said packs in cartons;
(h) means, associated with said means for packing cigarettes in packs, said means for wrapping cigarette packs and said means for packing packs in cartons, for rejecting defective cigarette packs;
(i) means, communicating with said defective cigarette pack rejecting means, for non-intrusively opening rejected defective cigarette packs;
(j) smokable material reclamation means for separating smokable material filler from cigarettes, said reclamation means communicating with said defective cigarette rejecting means and said pack opening means
(i) buffer means for arranging cigarettes in-line;
(ii) means for weakening the cigarette paper of each cigarette along the longitudinal axis thereof;
(iii) means for applying pressure to the cigarettes, thereby breaking the weakened paper; and
(iv) brush means for separating the smokable material from the cigarettes; and
(k) means for transporting said reclaimed smokable material filler to said means for making cigarette rods.

34. An apparatus as in claim 33, wherein said pack opening means comprises means for opening at least one end of each rejected cigarette pack, means for deforming the pack so as to increase the transverse cross-sectional area thereof, and means for extracting the cigarettes from the pack through said at least one open end thereof.

* * * * *

UNITED STATES PATENT AND TRADEMARK OFFICE

CERTIFICATE OF CORRECTION

PATENT NO. : 5,117,843
DATED : June 2, 1992
INVENTOR(S) : Gregory A. Holmes, et. al.

It is certified that error appears in the above-indentified patent and that said Letters Patent is hereby corrected as shown below:

Col. 9, line 26, delete "0"--.

Col. 12, line 47, "S " should be --S"--.

Col. 13, line 48, after "the", first occurrence, delete "5"--.

Col. 17, line 33, after "means", second occurrence, insert --for rejecting defective cigarette packs; (f) means for non-intrusively opening defective packs and removing the cigarettes thereforom;--.

Signed and Sealed this

Twenty-eighth Day of September, 1993

Bruce Lehman

*Attest:*

BRUCE LEHMAN

*Attesting Officer*

*Commissioner of Patents and Trademarks*